United States Patent [19]

Sakanashi et al.

[11] Patent Number: 4,767,103

[45] Date of Patent: Aug. 30, 1988

[54] CONVERTOR PRESSURE CONTROL DEVICE IN A CONVERTOR WASTE GAS DISPOSING DEVICE

[75] Inventors: Nobuhiro Sakanashi, Fukuoka; Toru Yoshida; Yujiro Ueda, both of Osaka; Katsumi Hachiga, Kanagawa; Shigeharu Kawai, Tokyo, all of Japan

[73] Assignees: Nippon Steel Corporation, Tokyo, Japan; Fuji Electric Co., Ltd., Kanagawa, Japan

[21] Appl. No.: 822,597

[22] Filed: Jan. 27, 1986

[30] Foreign Application Priority Data

Jan. 28, 1985 [JP] Japan ..... 60-12568

[51] Int. Cl.[4] ..... C21C 5/38

[52] U.S. Cl. ..... 266/80; 266/89; 266/158; 266/159

[58] Field of Search ..... 266/80, 89, 158, 159

[56] References Cited

U.S. PATENT DOCUMENTS 4,050,679 9/1977 Sakai ..... 266/89

4,192,486 3/1980 Ueda et al. ..... 266/158

FOREIGN PATENT DOCUMENTS 19484 6/1972 Japan ..... 266/89

*Primary Examiner*—L. Dewayne Rutledge

*Assistant Examiner*—Robert L. McDowell

*Attorney, Agent, or Firm*—Finnegan, Henderson, Farabow, Garrett and Dunner

[57] ABSTRACT

A converter pressure control device for use in a converter waste gas disposing device wherein a calculator determines the difference between the pressure in a converter and atmospheric pressure and sets an operating parameter according to the detected difference. A pressure controller generates a control signal in accordance with the operating parameter and the difference in converter pressure and a predetermined value. The control signal is used to operate a damper to control the flow of waste gas through the converter.

6 Claims, 3 Drawing Sheets

CONVERTOR PRESSURE CONTROL DEVICE IN A CONVERTOR WASTE GAS DISPOSING DEVICE

FIELD OF THE INVENTION

This invention relates to a converter pressure controlling device implementing an improved procedure for controlling converter control parameters for a converter waste gas disposing device.

BACKGROUND OF THE INVENTION

The waste gas produced in blowing oxygen gas against molten iron in an oxygen-operated converter is generally a valuable gas that essentially contains carbon monoxide (CO) gas. The gas is recovered by cooling it and removing entrapped dust.

In the operation of a conventional converter waste gas disposing device, a suitable space is provided between a movable skirt, which is disposed between the opening of the converter and the hood, and the opening of the converter. In order to recover the CO gas (without burning it), it is necessary to prevent air from entering the converter through the gap between the skirt and the opening of the converter. This has been achieved by setting the gas pressure in the hood substantially equal to the atmospheric pressure. For this purpose, the gas pressure in the hood (hereinafter referred to as "the pressure in the converter" or "the converter pressure") is detected, and the flow rate of waste gas is controlled so that even if the production of gas in the converter varies irregularly, the pressure in the converter is maintained constant. In the case when the reaction in the converter is abruptly changed, for instance, by the addition of auxiliary raw materials during the smelting operation, the above-described converter pressure control sometimes fails to follow the change because of a delay in detecting the change, in transmitting the signal representing the gas pressure, or in responding at the control terminal. In this case, the waste gas may blow out of the converter through the gap between the skirt and the opening of the converter, or air may be forced into the converter through the gap to cause the combustion of the carbon monoxide gas, which is not economical. In order to eliminate this difficulty, heretofore the operator must manually adjust the gap by moving the skirt vertically.

The adjustment of the gap, however, sometimes changes the process parameters and makes the converter pressure control unstable or lowers the response characteristic. This phenomenon can be represented by a gas state equation and a gas pressure loss equation. That is, as for a process gain Kp the following relation can be established:

$$K_p = \frac{\sqrt{|Pa - Po|}}{\gamma} \quad (1)$$

where Pa is the atmospheric pressure, Po is the converter pressure, and $\gamma$ is the converter's opening pressure loss coefficient.

The coefficient $\gamma$ is decreased as the gap between the skirt and the opening of the converter decreases. This is the reason why the above-described phenomenon occurs. This will be described in more detail.

A PI or PID controller for converter pressure control has control parameters such as a proportion gain (Kc) in a proportion operation, a time constant $T_I$ in an integration operation, and a time constant ($T_D$) in a differentiation operation. These parameters are set to suitable values according to the process characteristic of a system to be controlled. Therefore, if when the process characteristic of the system to be controlled changes the parameters remain unchanged, then the control operation may become unstable.

In the above-described converter pressure control system, the variation of the gap between the skirt and the converter's opening changes the process characteristic. Considering only the proportion operation of the controller, even if a waste gas flow-rate control device (such as a secondary damper) is driven when the gas is sufficiently large, the pressure in the converter is changed only a little because air can readily go in and out of the converter through the large gap. Consequently, the proportion gain Kc of the controller may be large.

On the other hand, in the case where the gap is small, the pressure in the converter is greatly changed when the waste gas flow-rate control device is driven, and, therefore, the proportion gain Kc must be small. If the proportion gain Kc is large in the former case where the gap is large, the operation of the controller becomes slow, as a result of which the pressure in the converter is greatly changed. Accordingly, a large quantity of air goes into the converter through the gap so that the CO gas to be recovered is burned, or the waste gas blows out of the converter through the gap to cause air pollution. On the other hand, if the proportion gain Kc is small in the latter case where the gap is small, the pressure in the converter oscillates, and the control operation becomes unstable.

As is apparent from the above description, if the control parameters are maintained constant at all times, when the above-described difficulties occur when the gap between the skirt and the opening of the converter is changed. These difficulties may be eliminated by employment of a method in which the variation of the gap is detected by obtaining the quantity of air flowing into the converter, and the control parameters of the controller are adjusted according to the variation of the gap thus detected.

According to such a method, the control parameters can be adjusted for the gap between the skirt and opening of the converter. The difference pressure component $\sqrt{|Pa-Po|}$ in the above-described relation (1) has not been a serious factor because, when the gap between the skirt and the opening of the converter is large, the variation of the converter is not more than 5 or 6 mm $H_2O$.

If the smelting operation is carried out with the skirt brought in close contact with the opening of the converter in order to increase the quantity of recovery of CO gas, the converter pressure is varied more than 100 mm $H_2O$ with the same variation of the quantity of gas produced in the converter. Therefore, according to the above-described relation (1) the process gain becomes ten times as large. Accordingly, even if the control parameters are adjusted for the gap between the skirt and the opening of the converter, the pressure in the converter will oscillate. As a result, it becomes impossible to continue the smelting operation.

OBJECTS AND SUMMARY OF THE INVENTION

An object of the present invention is a converter pressure control device in a converter waste gas disposing device that operates in a stable manner.

Another object of the present invention is the efficient recovery of waste gas generated during smelting operations.

A further object of the present invention is a converter pressure control device that responds quickly to changes in smelting conditions during the recovery of converter waste gas.

Still another object of the present invention is a converter pressure control device in a converter waste gas disposing device which is capable of accommodating large variation in smelting conditions.

These and other objects are attained by a converter pressure control device for use in a converter waste gas disposal device comprising means for detecting the pressure in a converter, calculating means for determining a variation in a characteristic parameter of the waste gas disposing device from the difference between the detected converter pressure and atmospheric pressure, parameter determining means for determining an operating parameter in accordance with the variation in the characteristic parameter, converter pressure controlling means for comparing the detected converter pressure with a predetermined value and for generating a control signal corresponding to the difference between the detected converter pressure and the predetermined value and to the operating parameter, and means for controlling the flow rate of waste gas produced in the converter according to the control signal to establish the pressure in the converter at a predetermined value.

BRIEF DESCRIPTION OF THE DRAWINGS

The manner by which the above objects and other objects, features, and advantages of the present invention are attained shall become fully apparent from the following detailed description when considered in view of the drawings, wherein.

FIGS. *2a, b, c* is a diagram illustrating the relationship between the quantity of gas produced in a converter and the pressure in the converter.

DETAILED DESCRIPTION

According to the present invention, the control parameters are adjusted for variations in a characteristic parameter or parameters of a waste gas disposing device which are due to a large variation in converter pressure, so that the smelting operation may be carried out safely and stably. In such a device, one such characteristic parameter may be the process gain $K_p$, which is obtained from the following equation:

$$Kp = Kpo\sqrt{|Pa - Po|} \quad (2)$$

where Kpo is the process gain with Pa−Po=1 (mm $H_2O$). Therefore, the control parameter, i.e., the proportion gain Kc, is adjusted according to the following equation:

$$Kc = Kco \min(1, Kpo/Kp) \quad (3)$$

where Kco is the most suitable gain with respect to Kpo.

Figure 1:
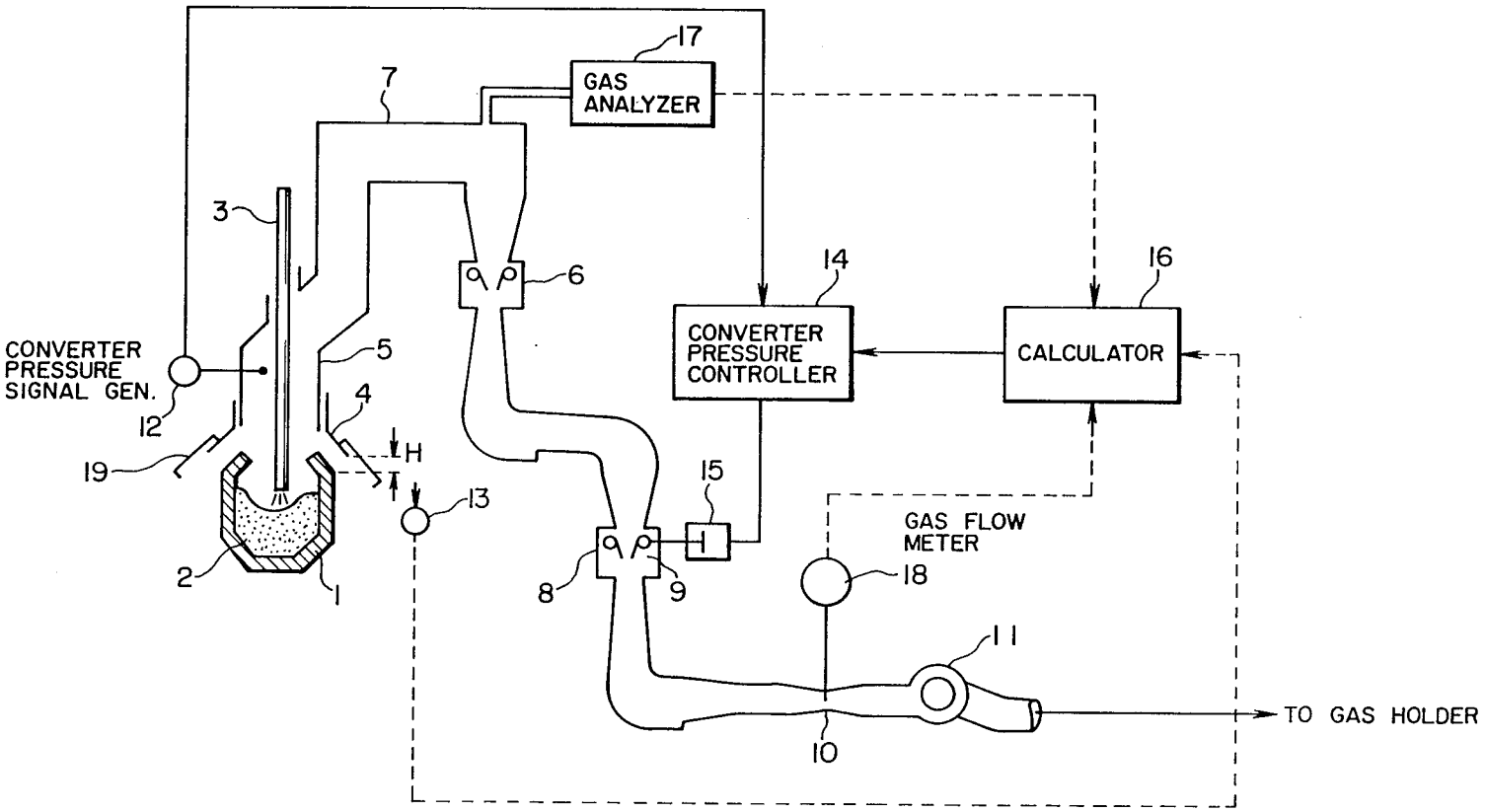
FIG. 1 schematically illustrates an embodiment of the converter pressure control device of the present invention.

FIG. 1 is an explanatory diagram outlining an embodiment of the present invention. First, the arrangement of a converter waste gas disposing device (OG) will be described. After scrap iron and molten pig iron 2 are put in the converter 1, high pressure oxygen gas is blown, through a pipe 3 against the scrap iron and molten iron 2. That is, a so-called "blow type" smelting operation is carried out. After the blow type smelting operation, the converter 1 is tilted to dump out the produced steel.

In the blow type smelting operation, the oxygen gas jet through the pipe 3 reacts with the carbon C of the molten pig iron to produce a large quantity of waste gas rich in carbon monoxide CO. At the same time, the surface of the steel bath, against which the oxygen gas jet strikes, is heated to a considerably higher temperature than the rest of the molten steel so that the iron (Fe) of the steel bath is vaporized causing a large quantity of iron oxide powder to be produced. The waste disposing device is made up of a section for cooling a large quantity of high-temperature waste gas, and a section for collecting dust.

The large quantity of high temperature waste gas produced is sucked by an induction blower 11 through a flue. The waste gas is cooled by a gas cooler 7 made up of a number of cooling water pipes for instance. Coarse dust is collected by a primary dust collector 6, and fine dust is collected by a secondary dust collector 8, to purify the waste gas.

The purified waste gas flows through the induction blower 11, and is recovered as fuel by a gas holder or the like (not shown). In the converter 1, a large quantity of waste gas is produced during the middle period of the blow type smelting operation; however, the quantity of waste gas produced in the initial or final period thereof is relatively small. When auxiliary raw material is put in the converter 1 or the flow rate of the oxygen gas jet through the pipe 3 is changed, the quantity of waste gas produced also changes. Therefore, in order to maintain the gas pressure in the hood 5 in a range of suitable gas pressures, the flow rate of the waste gas is controlled. In accomplishing this, the gas pressure Po in the hood 5 (hereinafter referred to as "the pressure in the converter", or "the converter pressure") is detected. The detected gas pressure value is applied to a controller 14 by a converter pressure signal generator 12. In the controller 14, the gas pressure value is compared with a predetermined value, and an operating output signal is applied to a damper operating unit 15 so that the difference between the two values is zeroed. As a result, the opening and closing operation of secondary damper 9 is controlled, whereby the flow rate of the waste gas is controlled.

In a closed-type smelting operation, which is carried out to increase the quantity of waste gas recovered, a skirt 4 is moved downwardly until it is brought into close contact with the opening of the converter. An outside seal 19 may also be closed in order to further increase the degree of closure. In a blow type smelting operation under this condition, the converter pressure is greatly changed.

In this case, the control gain of the controller 14 is determined as follows: The difference between the measured converter pressure Po and the atmospheric pressure Pa is detected, and, with the aid of a calculator 16, a process gain Kp and a proportion gain Kc are obtained according to equations (2) and (3), respectively. The difference thus detected is to determine the control gain of the controller 14.

The case where the proportion gain of the controller is adjusted has been described; however, it goes without saying that control parameters such as the integration time constant or differentiation time constant thereof can be adjusted according to the same principle when required. The integration time constant and the differentiation time constant will be described.

The integration time constant and the differentiation time constant concern delay time constants in the process to which the present invention relates.

The delay time constants are as follows:

Damper time constant: $T_1$

Damper waste time: $T_L$

Process time constant: $T_P$

Figure 3:
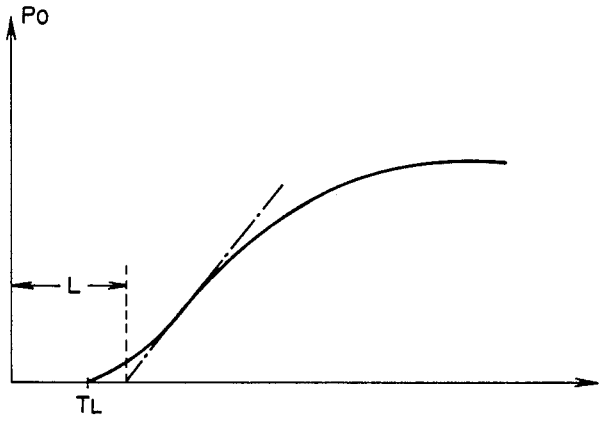
FIG. 3 is a graphical representation of the step response waveform of the converter pressure control device of the present invention.

In this case, the step response waveform is as shown in FIG. 3, and, according to Chien's law, the integration time constant $T_I$ and the differentiation time constant $T_D$ are as follows:

$$\left.\begin{aligned} T_D &= 0.42L \\ T_I &= 2L \end{aligned}\right\} \quad (4)$$

where L is determined by $T_L$ and $T_P$ ($T_I > T_P$), and $$L = T_L + \alpha T_P \quad (5)$$

where $\alpha$ is the constant.

On the other hand, as for the process time constant $T_P$ and $\sqrt{|Pa-Po|}$, the following relation can be established similarly as in the equation (1):

$$T_P \propto \frac{\sqrt{|Pa - Po|}}{\gamma} \quad (6)$$

The process time constant $T_P$ is obtained from the following equation:

$$T_P = T_{PO}\sqrt{|Pa-Po|} \quad (7)$$

where $T_{PO}$ is the process time constant with Pa−Po=1 (mm $H_2O$).

Therefore, if with Pa−Po=1 (mm$H_2O$) the $$\frac{T_P}{T_{Po}} = \sqrt{|Pa - Po|} = \frac{T_I - 2T_L}{T_{Io} - 2T_L} \quad (13)$$

integration time constant and the differentiation time constant are represented by $T_{IO}$ and $T_{DO}$, respectively, then $$T_{IO} = 2L = 2(T_L + \alpha T_{PO}) \quad (8)$$

$$T_{DO} = 0.42L = 0.42(T_L + (XT_{PO})) \quad (9)$$

Therefore, $$T_{PO} = \frac{1}{2\alpha}(T_{IO} - 2T_L) \quad (10)$$

-continued $$T_{PO} = \frac{1}{0.42\alpha}(T_{DO} - 0.42T_L) \quad (11)$$

From the equation (7), $$\frac{T_P}{T_{PO}} = \sqrt{|Pa - Po|} \quad (12)$$

From equations (4), (5), (10) and (12), $$\frac{T_P}{T_{PO}} = \sqrt{|Pa - Po|} = \frac{T_I - 2T_L}{T_{IO} - 2T_L} \quad (13)$$

From the equation (13), $$T_I = 2T_L + \sqrt{|Pa-Po|}(T_{IO} - 2T_L) \quad (14)$$

From the equations (4), (5), (11) and (12), $$\frac{T_p}{T_{Po}} = \sqrt{|Pa - Po|} = \frac{T_D - 0.42\,T_L}{T_{Do} - 0.42\,T_L} \quad (15)$$

$$T_D = 0.42T_L + \sqrt{|Pa-Po|}(T_{DO} - 0.42T_L) \quad (16)$$

Thus, according to equations (14) and (16), the control parameters, the integration time constant $T_I$, and the differentiation time constant $T_D$, can be set to suitable values by utilizing the difference between the converter pressure Po and the atmospheric pressure Pa.

It goes without saying that with the present invention, a controller is used whereby the parameters can be automatically changed according to the above-described calculation outputs. Therefore, a digital controller is most easily employed.

Figure 2A:
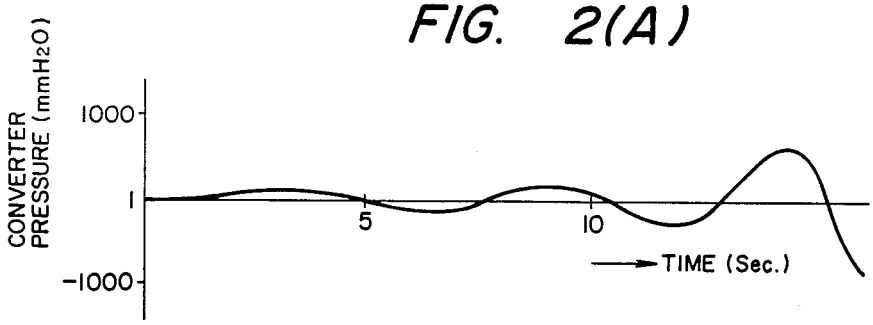
Figure 2B:
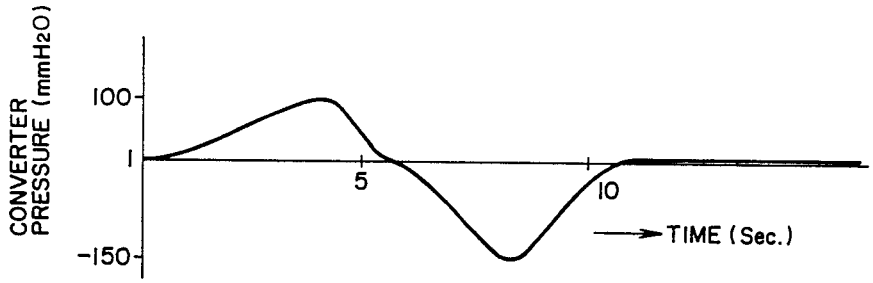
Figure 2C:
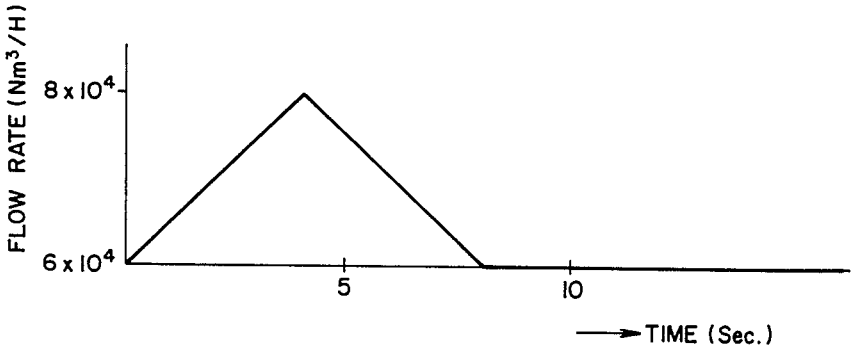

The effects of the present invention will be described with reference to FIG. 2. It is assumed that, as shown in part (c) of FIG. 2, the flow rate of waste gas produced by the reaction in the converter is abruptly changed. If, in this case, suitable control is not carried out, the converter pressure oscillates and diverges because of its initial variation as shown in part (a) of FIG. 2. If, on the other hand, suitable control is effected, as shown in part (b) of FIG. 2 the converter pressure is changed immediately after the variation in flow rate of the waste gas produced in the converter. It becomes stable quickly, however, for example in the ten seconds. That is, the converter pressure is satisfactorily controlled.

In other words, even when the converter pressure changes greatly as in the closed type smelting operation, the control is stable according to the present invention. The converter pressure control device of the present invention works satisfactorily under severe operating conditions, and contributes to an improvement in the percentage of recovery of waste gas and the safety of the smelting operation.

It should be understood that the present invention is not limited to the particular embodiment described, but rather is susceptible to modifications, alterations, and equivalent arrangements within the scope of the appended claims.

We claim:

1. A converter pressure control device for use in a converter waste gas disposing device comprising:

means for detecting the difference between the pressure in the converter and atmospheric pressure and for generating a pressure differential signal corresponding thereto;

parameter determining means for calculating a control parameter in accordance with the values of a set of characteristic parameters;

calculating means for setting the values of said characteristic parameters in accordance with said pressure differential signal; and means for controlling the flow rate of waste gas produced in the converter according to said control parameter to establish the pressure in the converter at a selected value whereby the flow rate of waste gas is controlled as a function of the difference between the converter pressure and atmospheric pressure.

2. A device according to claim 1, wherein said control parameter is a proportion gain.

3. A device according to claim 1, wherein said control parameter is an integration time constant.

4. A device according to claim 1, wherein said control parameter is a differentiation time constant.

5. A device according to claim 1, wherein said controlling means comprises a damper.

6. A converter pressure control device for use with a converter waste gas disposing device comprising:

means for detecting the pressure in a converter;

means for controlling the flow rate of waste gas produced in the converter to establish the pressure in the converter;

converter pressure controlling means for generating a control signal for controlling said waste gas flow rate controlling means to establish a selected pressure in the converter; and calculator means for computing the differential time constant or the integration time constant of said converter pressure controlling means from the difference between said detected pressure in the converter and atmospheric pressure and for providing said computed differential time constant or integration time constant to said converter pressure controlling means for use in generating said control signal such that the flow rate of waste gas in the converter is controlled in accordance with the difference between the detected pressure in the converter and atmospheric pressure.

* * * * *